US007835916B2

(12) United States Patent
Bruhn

(10) Patent No.: US 7,835,916 B2
(45) Date of Patent: Nov. 16, 2010

(54) CHANNEL SIGNAL CONCEALMENT IN MULTI-CHANNEL AUDIO SYSTEMS

(75) Inventor: Stefan Bruhn, Sollentuna (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1001 days.

(21) Appl. No.: 11/012,717

(22) Filed: Dec. 16, 2004

(65) Prior Publication Data

US 2005/0182996 A1 Aug. 18, 2005

Related U.S. Application Data

(60) Provisional application No. 60/530,652, filed on Dec. 19, 2003.

(30) Foreign Application Priority Data

Feb. 20, 2004 (SE) ..... 0400416

(51) Int. Cl.
*G10L 19/00* (2006.01)

(52) U.S. Cl. ..... 704/500; 704/501; 704/200; 704/201

(58) Field of Classification Search ..... 704/200, 704/201, 500, 501
See application file for complete search history.

(56) References Cited

U.S. PATENT DOCUMENTS 6,081,783 A * 6/2000 Divine et al. ..... 704/500
6,490,551 B2 * 12/2002 Wiese et al. ..... 704/201
6,665,637 B2 * 12/2003 Bruhn ..... 704/206
6,675,145 B1 * 1/2004 Yehia et al. ..... 704/270

(Continued)

FOREIGN PATENT DOCUMENTS

DE 3638922 A1 5/1988

(Continued)

OTHER PUBLICATIONS

Harma, A.; Laine, U.K.; Karjalainen, M.; "An experimental audio codec based on warped linear prediction of complex valued signals,"Acoustics, Speech, and Signal Processing, 1997. ICASSP-97., 1997 IEEE International Conference on vol. 1, Apr. 21-24, 1997 pp. 323-326 vol. 1.*

(Continued)

*Primary Examiner*—Richemond Dorvil
*Assistant Examiner*—Douglas C Godbold
(74) *Attorney, Agent, or Firm*—Nixon & Vanderhye, P.C.

(57) ABSTRACT

A parametric model is used for error concealment. The model filter allows for recovering signal components of original audio channel signals that now are lost or erroneous from signal components of at least one other audio channel. During error-free reception of valid frames, the parameters of that model will be derived and stored. In case of frame loss or frame error affecting the multi-channel information, a conjecture of the missing information is recovered by applying the model, using the stored parameters. In case of several subsequent lost or erroneous frames, it is possible either to use the parameters derived during the last valid frame or to use parameters derived from the recovered multi-channel information of the respective previous invalid frame. Furthermore, if there are long sequences of lost frames, it can be beneficial to apply some gradual muting of the model parameters, which essentially results in a gradual attenuation of the recovered multi-channel information.

28 Claims, 9 Drawing Sheets

U.S. PATENT DOCUMENTS

| | | | | |
|---|---|---|---|---|
| 6,757,654 | B1 * | 6/2004 | Westerlund et al. | 704/262 |
| 6,775,649 | B1 * | 8/2004 | DeMartin | 704/201 |
| 7,013,267 | B1 * | 3/2006 | Huart et al. | 704/207 |
| 7,031,926 | B2 * | 4/2006 | Makinen et al. | 704/500 |
| 7,177,278 | B2 * | 2/2007 | LeBlanc | 370/235 |
| 7,206,986 | B2 * | 4/2007 | Stemerdink et al. | 714/747 |
| 2002/0123887 | A1 * | 9/2002 | Unno | 704/220 |
| 2004/0010407 | A1 * | 1/2004 | Kovesi et al. | 704/219 |
| 2004/0153318 | A1 * | 8/2004 | Chamberlain | 704/222 |
| 2004/0260542 | A1 * | 12/2004 | Ananthapadmanabhan et al. | 704/219 |
| 2008/0004883 | A1 * | 1/2008 | Vilermo et al. | 704/500 |

FOREIGN PATENT DOCUMENTS

| | | | |
|---|---|---|---|
| EP | 0 637 013 | A1 | 2/1995 |
| EP | 0 892 582 | | 1/1999 |
| EP | 1 103 953 | A2 | 5/2001 |
| JP | 10-116096 | A | 5/1998 |
| JP | 10-336796 | A | 12/1998 |
| JP | 2000-59231 | A | 2/2000 |
| JP | 2001-154699 | A | 6/2001 |
| JP | 2001-296894 | A | 10/2001 |
| WO | WO 02/07149 | | 1/2002 |
| WO | 03/069954 | | 8/2003 |
| WO | WO-03/107591 | * | 12/2003 |
| WO | WO 03/107591 | | 12/2003 |
| WO | WO 2004/038927 | | 5/2004 |

OTHER PUBLICATIONS

Tech Spec., 3GPP TS 26.091, "Mandatory Speech Codec Speech Processing Functions; AMR Speech Codec; Error Concealment of Lost Frames", V4.0.0, Mar. 2001.

"A Drumbeat-Pattern Based Error Concealment Method for Music Streaming Applications", Wang, 2002 IEEE pp. 2817-2820.

"A Survey of Error-Concealment Schemes for Real-Time Audio and Video Transmissions over the Internet", Wah et al., 2000 IEEE, pp. 17-24.

"Loss Concealment for Multi-Channel Streaming Audio", Sinha et al., NOSSDAV Jun. 2003.

International Search Report dated Apr. 6, 2005.

Faller et al, "Binaural Cue Coding—Part II: Schemes and Applications", IEEE Transaction on Speech and Audio Processing, vol. 11, No. 6, Nov. 2003, pp. 520-531.

* cited by examiner

Fig. 1C
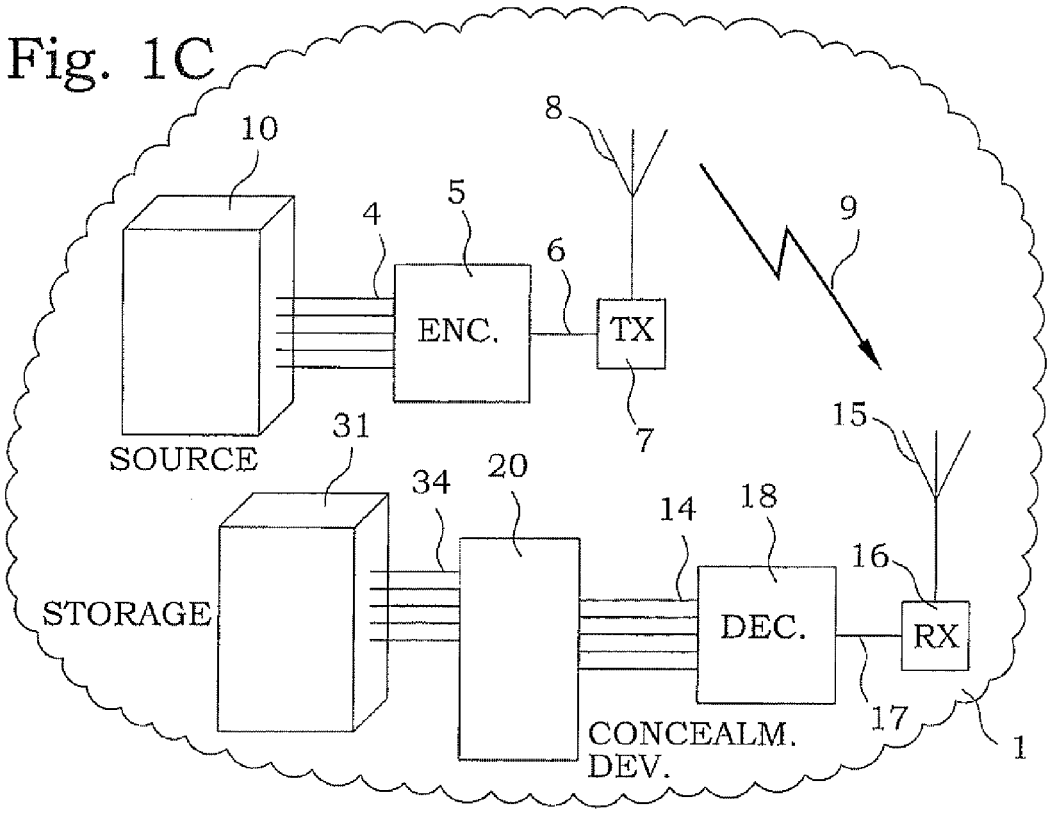
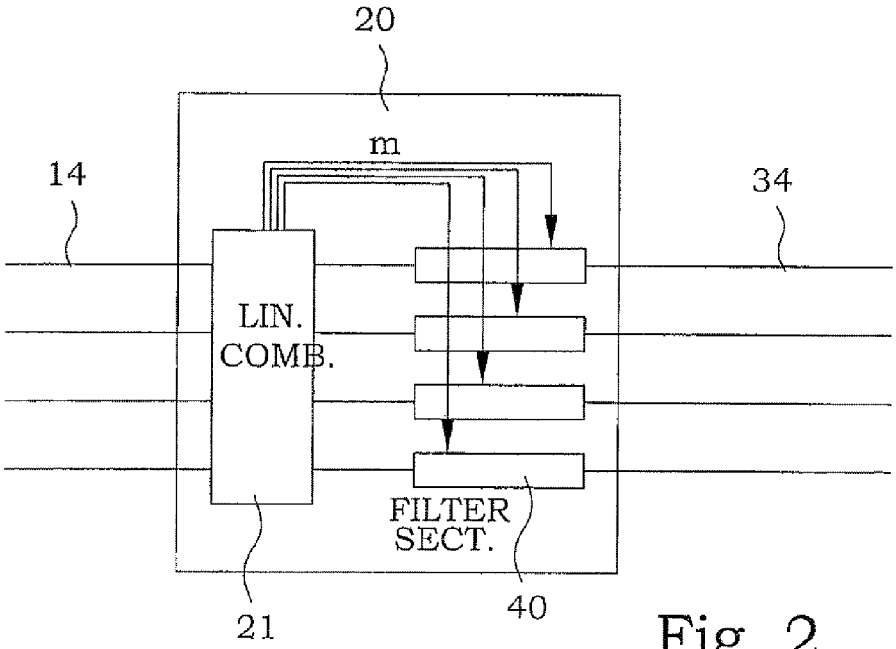
Fig. 2

Fig. 6
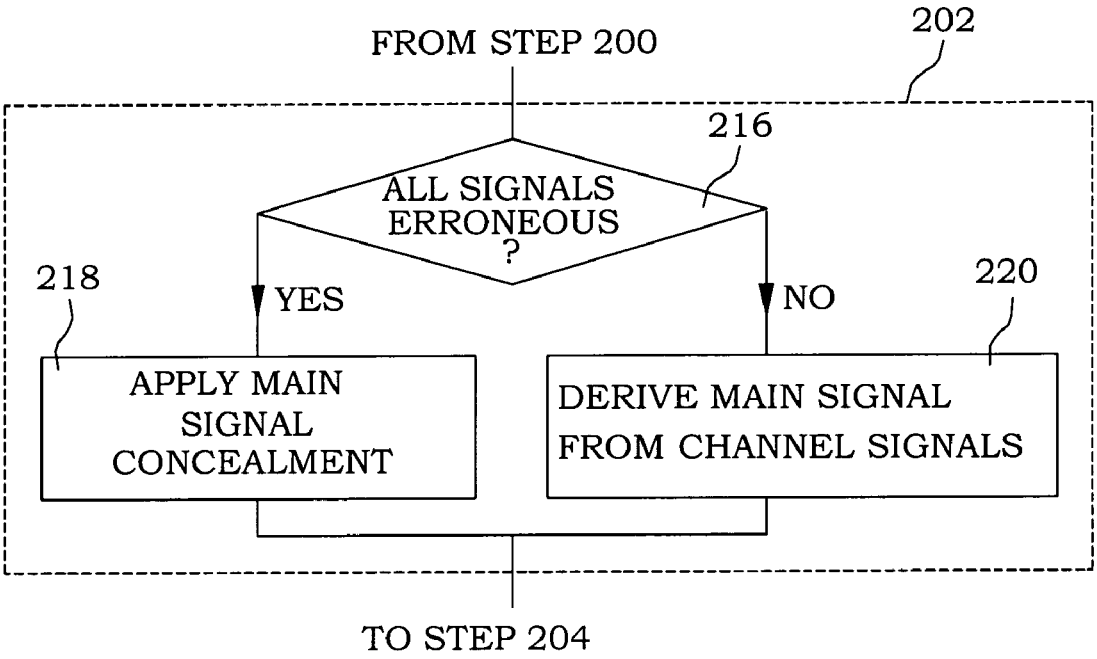
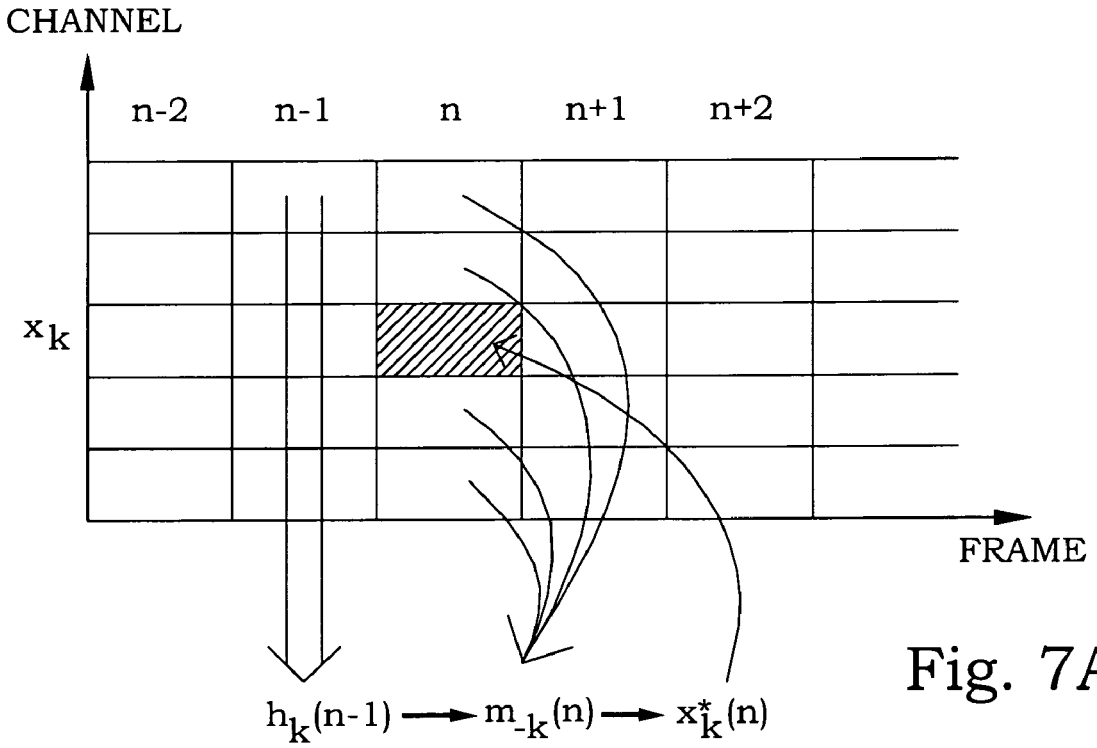
Fig. 7A

CHANNEL SIGNAL CONCEALMENT IN MULTI-CHANNEL AUDIO SYSTEMS

This application claims priority to and benefit of U.S. Provisional Application No. 60/530,652, filed 19 Dec. 2003 and Swedish application number 0400416-4 filed Feb. 20, 2004. The entire contents of these applications are incorporated herein by reference in their entirety.

TECHNICAL FIELD

The present invention relates in general to methods and devices of multi-channel audio systems, and in particular to methods and devices for concealment of erroneous channel signals.

BACKGROUND

There is a large interest in handling audio signals, and in particular multi-channel audio signals. Audio signals are achieved, either as direct recordings or generation of stereophonic sound or as retrieval of earlier stored representations of audio signals, and transmitted in some way to an end unit, such as a loudspeaker system or storage for audio signals. In digital signal systems, the audio signals are typically encoded before being transmitted, and decoded at the receiver side.

Parametric encoding is found to be very attractive, since the required bit rate for transmitting multi-channel data can be reduced significantly compared to mere waveform encodings. There are several examples of parametric encoding schemes in prior art.

Regardless of what transmission method is used, communications systems are typically associated with error-prone transmission channels, e.g. in wireless communication or through the Internet. There are several levels of combating erroneously received signals. Directly in the transmission layer, there are error handling routines, such as forward error correction (FEC) and retransmission schemes, which try to compensate for certain types of transmission-induced errors. However, some errors cannot fully be repaired by such transmission-error schemes and the decoders, in the case of digital signals, have to be configured to receive also corrupted signals or even cope with lost signal portions. Typically, the decoders will receive coded data corresponding to frames of the input signal and there is typically a flag indicating if the frame data is error-free or corrupted or lost, i.e. unusable. In case of unusable data, the decoder will not be able to decode and reconstruct the corresponding signal frame. Instead means for frame loss concealment will be deployed, rendering the loss as inaudible as possible.

In case of stereophonic or multi-channel audio signals the frame loss may specifically affect the stereo or multi-channel audio representation. E.g. if one of the transmitted channels is affected, the decoder may still be able to reconstruct the other channel, or, depending on the chosen equivalent representation, it may still be possible to reconstruct a monophonic signal. However, a sudden loss of one of the audio channels as well as e.g. the sudden change from a stereo to a mono signal will harm the perceived audio quality. An important part of audio codec error concealment is thus the mitigation of losses of stereophonic or multi-channel information.

Most signal loss concealment methods of prior art are directly connected to the type of encoding used during a transmission step. Depending on the type of audio codec, parametric or non-parametric, there are various ways to realize error concealment for audio codecs in general including those for stereophonic or multi-channel audio. Common for all of these are that they are performing concealment attempts during or in direct connection to the actual decoding process.

Non-parametric audio codecs will typically repeat or estimate e.g. by means of interpolation correctly received signal values in order to generate a substitution for the erroneous values. As an example, the U.S. Pat. No. 6,490,551 by Wiese et. al. teaches substituting lost spectral components by estimates (e.g. by interpolation) from corresponding components of the same or another (stereo) channel including time or frequency domain sampled values. The merit of this patent is that, as it claims, it maintains the stereophonic impression.

Another similar technique particularly for stereo signals is described in patent DE 3638922 according to which lost signal sections of one of the stereo channels are replaced by corresponding signal sections of the other channel.

Another similar technique particularly for stereo signals is described in the patent DE 3638922 according to which lost signal sections of one of the stereo channels are replaced by corresponding signal sections of the other channel.

Typical frame loss concealment for parametric audio codecs involves replacing an erroneous parameter by an earlier and correctly received corresponding parameter. This is a temporal technique widely used in speech codecs that is directly applicable for parametric audio codecs. It is described in detail e.g. in the 3GPP specification on error concealment of lost frames for the AMR speech codec, 3 GPP TS 26.091, clauses 6 and 7.

Patent EP 0 637 013 by Cluever describes a parametric frame loss concealment method for non-parametric monophonic speech codecs. The signal values from a correctly received speech frame are used to derive the parameters of a speech synthesis model. In case of a frame loss the missing speech frame is synthesized by applying that model using the parameters derived during the last valid speech frame. Such a technique could in principle be applied for error concealment in audio codecs, and in the multi-channel case channel by channel.

Among the loss concealment methods discussed above, most approaches restore the transmitted channels in multi-channel audio systems independently of each other, ignoring any statistical inter-channel dependencies. The methods of U.S. Pat. No. 6,490,551 and DE 3638922 do explicitly exploit inter-channel dependencies, but are limited as solutions of non-parametric codecs. Moreover, they employ a principle of repeating or interpolative estimation of correctly received signal values in order to generate a substitution for the erroneous values, which typically doesn't lead to the best perceptual quality.

SUMMARY

A general object of the present invention is thus to provide improved methods and devices for channel signal loss concealment, allowing more accurate generation of replacement signals of missing or erroneous signal components. Another object of the present invention is to provide concealment methods and devices, which are useful together with any encoding principles, and in particular with parametric encoding systems.

A parametric model is used, which allows for generating replacements of lost or erroneous components of an audio channel from an input signal. During error-free reception of valid frames, the parameters of that model will be derived and stored. In case of frame loss or frame error affecting the multi-channel information, the missing information or at least a conjecture of it is recovered or generated by applying the model using the stored parameters. The application of the model may involve filtering of input signal components of at least one other audio channel or some other signal not necessarily related to any audio signal. In case of several subsequent lost or erroneous frames, it is possible either to use the parameters derived during the last valid frame or to use parameters derived from the recovered multi-channel information of the respective previous invalid frame. It is also possible to combine both techniques, i.e. to use parameters, which have been derived as a combination of the stored parameters of the previous valid frame and the parameters derived from the recovered multi-channel information of the previous invalid frame. Furthermore, if there are long sequences of lost frames, it can be beneficial to apply some gradual muting of the model parameters, which essentially results in a gradual attenuation of the recovered multi-channel information. In case of complete muting, no multi-channel signal will be recovered, which results in falling back to a sole playback of the main or mono audio channel.

In case of loss not only of multi-channel information but also of the input signal information, first a state-of-the-art temporal error concealment technique is applied for recovering the input signal from input signal information received at an earlier time instance. Then, in a second step, the error concealment according to the invention is applied generating a conjecture of the original multi-channel information from the recovered input signal.

More generally, the multi-channel information recovery according to an example embodiment can be combined with traditional temporal error concealment techniques, which recover lost information of the respective same channels based on information received for these channels at an earlier time instance.

One advantage of an example embodiment is that losses of multi-channel information can be mitigated in an improved manner, since inter-channel correlations are utilized for recovering the original channel signals. Moreover, the example embodiment is very generally applicable and can e.g. be used in multi-channel audio signal transmission systems using any type of encoding techniques, or in systems not even utilizing signal encoding.

BRIEF DESCRIPTION OF THE DRAWINGS

The invention, together with further objects and advantages thereof, may best be understood by making reference to the following description taken together with the accompanying drawings, in which:

FIGS. 1A-C are a schematic block schemes of example embodiments of audio systems;

FIG. 2 is a block scheme of an example embodiment of a concealment device;

FIG. 6 is a part flow diagram showing a step of example embodiments according to the flow diagrams of FIGS. 5A-B in more detail;

FIGS. 7A-D are diagrams illustrating the data correlations according to example embodiments;

DETAILED DESCRIPTION

In the present disclosure, the term "multi-channel" is used to characterize more than one channel. For example, stereo channel systems are included in the term "multi-channel" systems. An alternative definition is a system of n channels, where $n \geqq 2$.

Furthermore, the term "erroneous signal" comprises all kinds of errors, also including the absence or loss of the signal.

A typical site for a concealment device is within or in the vicinity of a receiver or decoder. However, the present invention is due to its characteristic parts more generally applicable, and may be applied almost anywhere in multi-channel audio systems. For illustrating this, the present detailed description begins with a few examples of systems, in which the present invention is advantageously applicable.

Figure 1A:
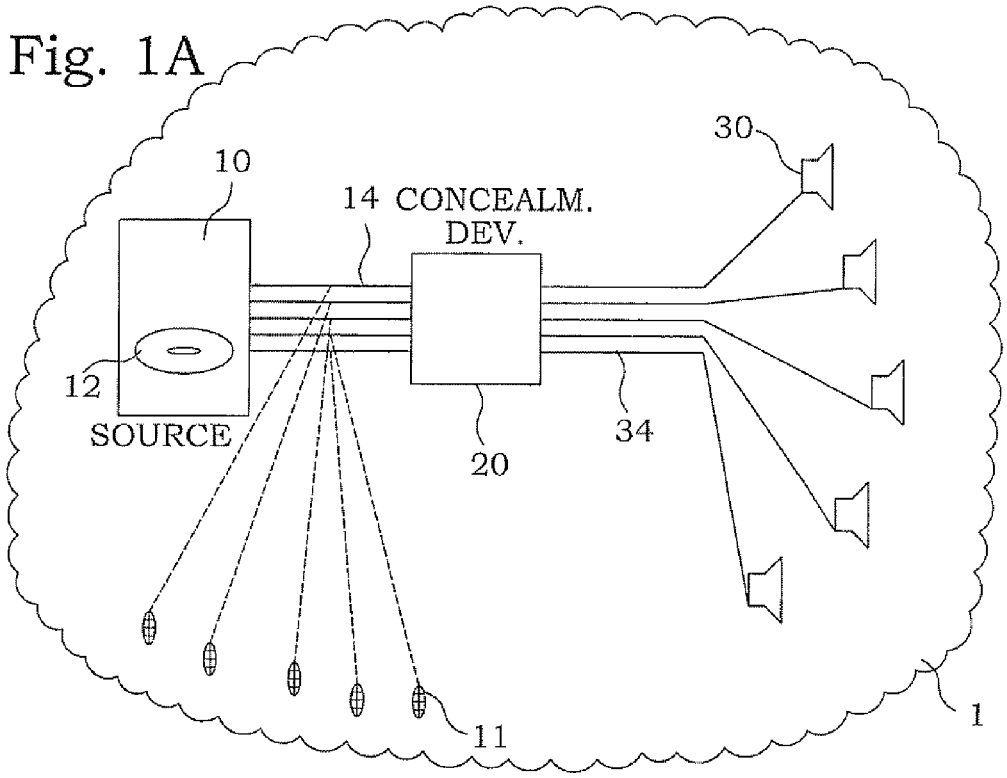

FIG. 1A illustrates an embodiment of an audio system 1 that is based on digital signals. A multi-channel signal source 10, retrieves stored signals from an audio signal storage 12, in this embodiment a CD of digitally encoded signals representing audio signals. The multi-channel audio signals are transmitted via source outputs 14. In an alternative system, the audio multi-channel signals could also be provided in real time, as indicated by broken lines and a set of microphones 11.

In the process of providing the audio signals, errors may occur. The signal content of the CD disk 12 could be deteriorated and difficult or impossible to interpret. The retrieval procedure could also produce some bit errors, giving totally or partly corrupted channel signals. A concealment device 20 according to the present invention could thereby by advantage be connected to the source outputs 14. The "repaired" multi-channel signals are then transmitted to destination inputs 34, in this embodiment connected to one respective loudspeaker 30.

Figure 1B:
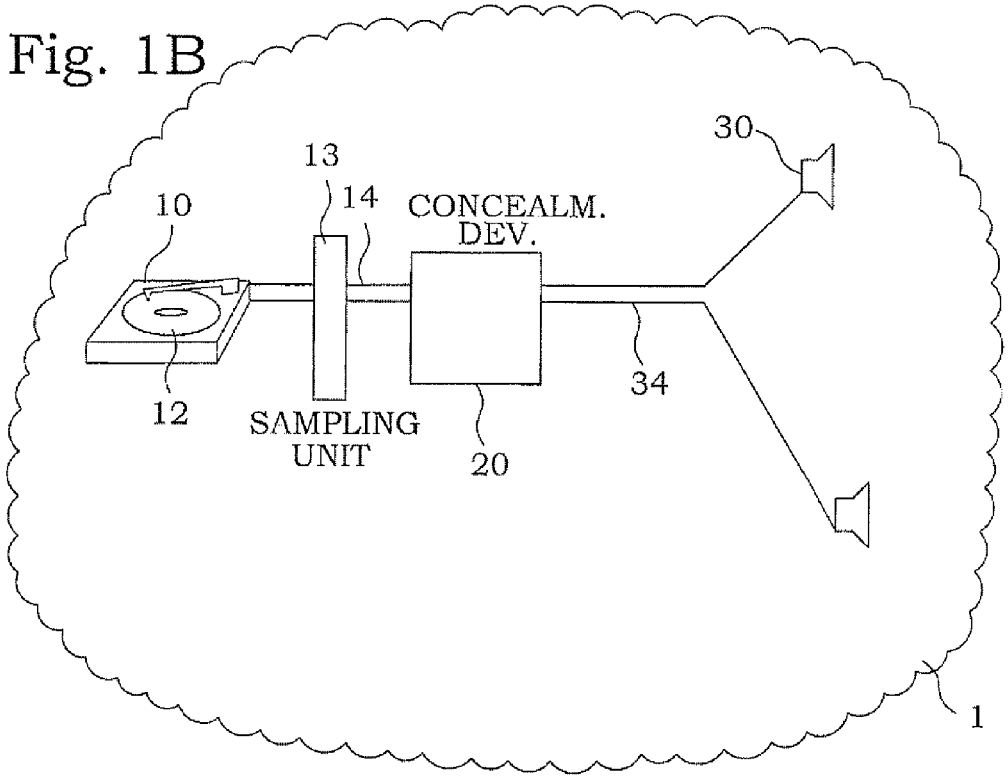

FIG. 1B illustrates another embodiment of an audio system 1, which in this case is based on a stereo source 10 of an analogue type. A vinyl disc 12 comprises audio signals encoded as geometrical undulations in tracks of the vinyl disc 10. The stereo-channel audio signals are via source outputs 14 provided to a sampling unit 13, which samples the analogue sound into digital representation. In other words, the sampling unit 13 operates as an analogue-to-digital converter for audio signals.

Also in this process of providing the audio signals, there are error sources. The signal content of the vinyl disk 12 could be mechanically altered e.g. by grains or scratches. The retrieval procedure could also produce errors significantly influencing the perceptual quality. Finally, the analogue-to-digital conversion may also give rise to totally or partly corrupted channel signals. A concealment device 20 according to the present invention could thereby by advantage be connected to the source outputs 14. The "repaired" multi-channel signals are then again transmitted to stereo destination inputs 34, in this embodiment connected to two loudspeakers 30.

FIG. 1C illustrates yet another embodiment of an audio system 1. Here, some multi-channel audio signals are downloaded from a multi-channel audio signal source 10, in this embodiment a music tracks provider. The multi-channel signals are retrieved from the source 10 and provided over a multi-channel connection 4 to an encoder 5. The encoder 5 converts the multi-channel signals into one common data stream transmitted via a connection 6 to a radio transmitter unit 7. Any type of encoding principles can be utilized. The radio transmitter unit 7 prepares to common data stream for being transmitted as radio signals 9 from a sender antenna 8 to a receiver antenna 15. A radio receiver unit 16 receives the signals and provides an as correct version of the original common data stream as possible via a connection 17 to a decoder 18. The decoder 18 converts the common data stream of connection 17 into a number of channel signals, provided at source outputs 14.

The radio part of this system is probably the main origin of errors in the audio signals. Both the radio receiver 16 and the decoder 18 typically comprise more or less complicated error-handling functionalities or concealment devices. However, a concealment device 20 according to an example embodiment could anyway be of advantage if connected to the source outputs 14. The "repaired" multi-channel signals are then again transmitted to multi-channel destination inputs 34, in this embodiment connected to an audio signal storage 31.

Audio signals transmitted through Internet are also often exposed to transmission errors. A corresponding concealment device 20 is therefore advantageously applied on the receiving side of an Internet based audio transmitting system.

A principle of the technology is that one channel signal out of a multi-channel signal set can be reproduced fairly accurate by applying a parametric filter to an input signal. The input signal may be any signal, e.g. a noise signal. However, in preferred embodiments, the input signal is dependent on a linear combination of at least one of the other multi-channel signals—giving a "main" signal. The main signal may be a mono signal, i.e. a signal representing the audio signals if they were recorded by only one source (microphone). However, other embodiments utilize a main signal that excludes the channel signal to be reproduced. FIG. 2 illustrates this principle more in detail. Channel signals are provided at source outputs 14. The concealment device 20 comprises a linear combination unit 21, which creates main signals m. In other embodiments, the main signal m could be provided from elsewhere. The main signal m is provided to a number of channel filter sections 40, in which concealment of an erroneous channel signal can be performed according to the example embodiment. The main signals provided to the different channel filter sections 40 could be the same main signal or different ones. The non-erroneous or concealed channel signals are provided to the destination inputs 34.

The channel filter sections 40 are based on parametric filters, controlled by a set of coefficients. These coefficients are adaptively derived during reception of valid frames from the channel signal in question and preferably from at least one of the other channels through the main signal. The computed parameters are stored in a parameter memory. In case of a frame loss or frame error, which affects at least parts of the channel signal in question, the parametric model is applied using the stored model parameters and the main signal of the at least one other channel signal. The resulting output signal of the parametric model may be used as a substitute for the lost channel signal or it may be combined with a channel signal that has been derived using any prior art technique in order to generate such a substitute.

Figure 3:
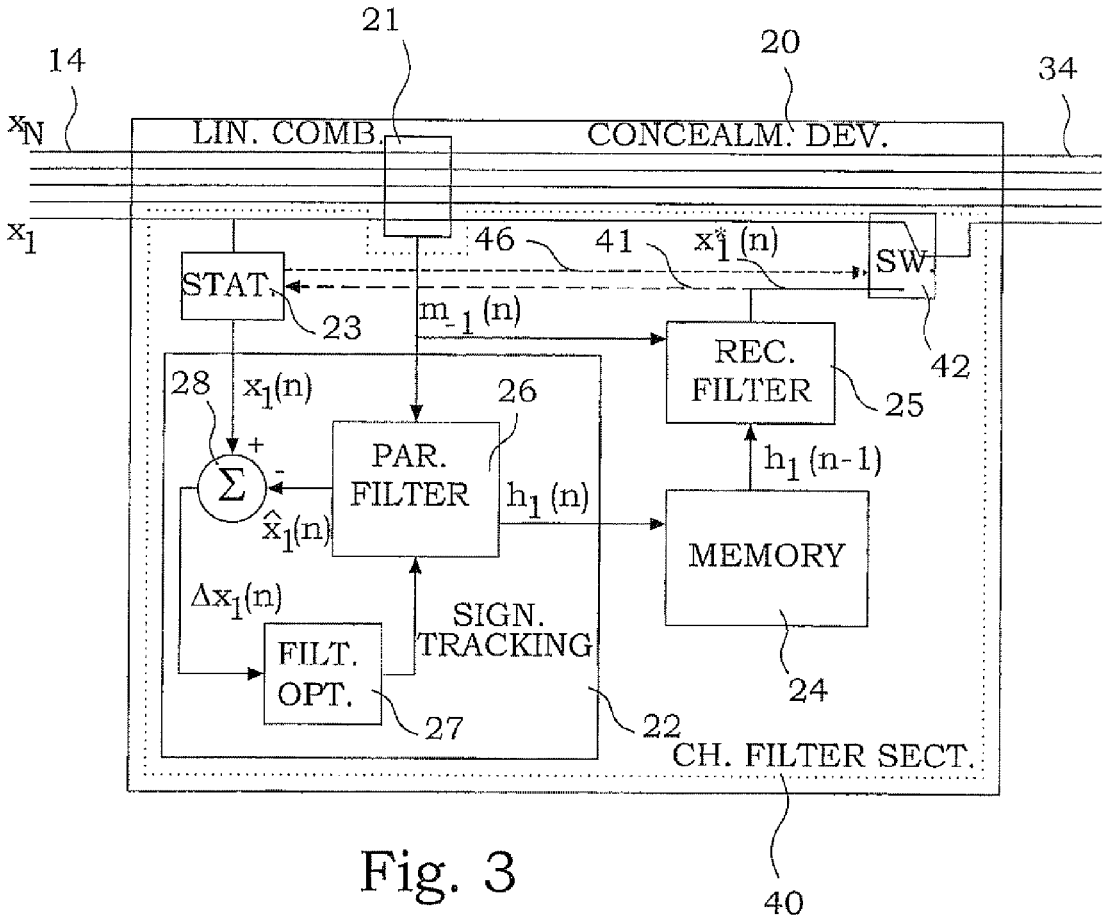
FIG. 3 is a block scheme of an example embodiment of a channel filter section.

FIG. 3 illustrates an example embodiment of one of the channel filter sections 40. The concealment device 20 connected to the source outputs 14 comprises a number of channel filter sections 40, preferably one per channel, of which only one is illustrated in FIG. 3. The illustrated channel filter section 40 is indicated as dotted. The illustrated channel filter section 40 affects the channel signal $x_1$, which is assumed to be divided in time portions, e.g. frames. The time portion n of the channel signal is denoted $x_1(n)$. An error status investigating means 23 is connected to the channel signal $x_1(n)$. If the signal portion is free from errors, i.e. a valid frame is present, the channel signal is forwarded to a signal tracking means 22. The linear combination unit 21 of the concealment device 20 provides a main signal $m_{-1}(n)$, which excludes the channel signal $x_1(n)$, to a parametric filter means 26 of the signal tracking means 22. The filter generates an output signal $\hat{x}_1(n)$, which is intended to be an estimate of the channel signal $x_1(n)$. An addition means 28 generates a difference signal $\Delta x_1(n)$, which is provided to a filter optimizing means 27, optimizing the parameters or coefficients of the parametric filter in order to minimize the difference signal $\Delta x_1(n)$ according to a minimum criterion. Preferably, the difference signal $\Delta x_1(n)$ is minimized in a mean-square or a weighted mean-square sense. Optimized parameters $h_1(n)$ achieved in this manner are provided as output signal from the signal tracking means 22, and represents the momentary correlation between the main signal $m_{-1}(n)$ and the channel signal $x_1(n)$. The optimized parameters $h_1(n)$ are stored in a memory 24 for later use.

The minimization procedure can alternatively be implemented by using a known Wiener filter error minimization procedure solving a linear equation system by, e.g., applying a Levinson recursion, discussed further below.

The channel signal $x_1(n)$ is connected in an unmodified manner through a switch means 42 to the multi-channel destination inputs 34.

If the error status investigating means 23 concludes that the present channel signal portion $x_1(n)$ is erroneous, entirely or partly, the channel signal portion is not forwarded to the signal tracking means 22. Instead, a control signal is provided for the switch means 42 to interrupt the channel signal portion. At the same time, the main signal $m_{-1}(n)$ is provided to a reconstruction filter 25, which is defined by parameters associated with the previous error-free channel signal portion $h_1(n-1)$. (The case of more than one sequential erroneous channel signal is discussed more in detail below.) An output signal $x_1^*(n)$ from the reconstruction filter 25 is a conjecture of the original, now erroneous, channel signal, generated from the main signal $m_{-1}(n)$ using the previous momentary correlation between the main signal $m_{-1}(n-1)$ and the channel signal $x_1(n-1)$. The switch means 42 replaces the incoming erroneous channel signal with the conjecture signal $x_1^*(n)$ in order to conceal the error in a best possible way.

In the case that several successive channel signal portions (frames) are erroneous, different approaches are possible to apply. In one embodiment, the reconstruction filter 25 uses the latest stored set of parameters associated with an error-free channel signal portion. This means that if two successive erroneous portions occur, the conjecture signal of the second one is based on the correlation between the main signal $m_{-1}(n-2)$ and the channel signal $x_1(n-2)$ for a channel signal portion two portions back. The longer the sequence of erroneous signals is, the more inaccurate the filter relevancy becomes.

In another embodiment, the conjecture signal $x_1^*(n)$ regenerated for a first erroneous channel signal is connected back, as illustrated by the broken line 41, to the signal tracking means 22 to form the basis of a new filter estimation. A concealment of a successive erroneous channel signal can then be based on always the latest available filter version, regardless whether this filter version is associated with an error-free or a conjecture signal.

In a third embodiment, a successive erroneous channel signal can be concealed using a signal deduced as a combination of the two previous approaches, i.e. a combination of the latest error-free filter and the latest conjecture signal based filter.

In the embodiments discussed above, the signal tracking by means of creation of parametric filters is performed on each individual channel signal.

Figure 4:
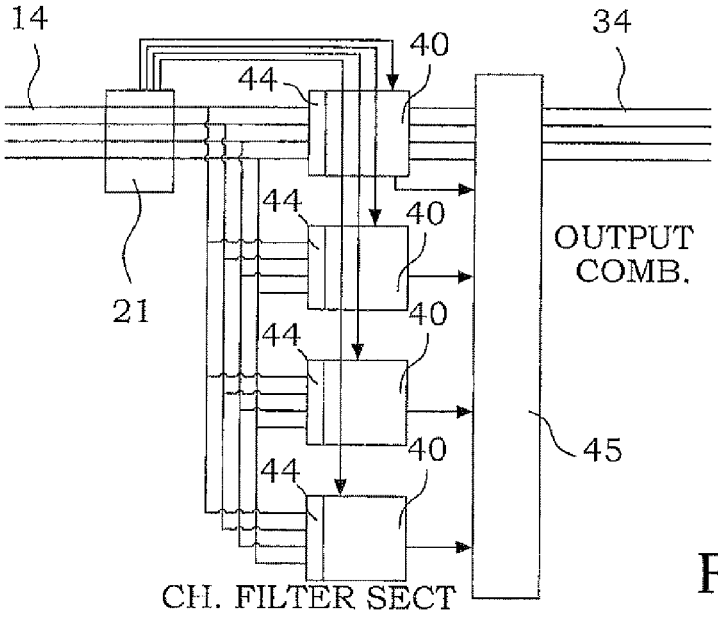
FIG. 4 is a block scheme of another example embodiment of a concealment device.

In other embodiments, it might instead be advantageous to use filters reproducing linear combinations of the channel signals instead. FIG. 4 illustrates such an alternative. Here, four channel filter sections 40 are provided, which are applied on linear combinations of the channel signals, created in respective linear combinators 44. In case of any erroneous signals, the conjecture signal outputs from the channel filter sections 40 are again linearly combined in an output combinator 45, in order to generate the replacement signals for the erroneous channel signals.

The channel signals may also themselves be linear combinations of original channel signals. For instance, a common approach for transmitting stereo audio signals is to transmit a mono signal, which is a mean of the two channel signals, and a side signal being half the difference between the original signals. In such a system, an error may very well appear in either the mono or side signal, whereby a channel signal concealment according to the present invention advantageously is performed e.g. on the side signal based on the mono signal.

In a more specific example of a stereophonic audio signal transmission system, an encode/decoder system uses a side and mono signal representation of the original input signal. The mono signal is defined as:

$$m(n) = \frac{x_1(n) + x_2(n)}{2},$$

while the side signal is given by:

$$s(n) = \frac{x_1(n) - x_2(n)}{2}.$$

The parametric model applied for error concealment according to the example embodiment of the invention is assumed to be a linear FIR (Finite Impulse Response) filter of order P with transfer function:

$$H(z) = \sum_{i=0}^{P} h(i) \cdot z^{-i}.$$

The input signal to the parametric model is a decoded mono signal m'(n) while the model generates an estimate ŝ'(n) of the decoded side signal ŝ'(n). An error minimization procedure calculates the filter coefficient vector $\underline{h}$ such that the filter output signal ŝ'(n) best matches the side signal s'(n). There are known error minimization procedures that can be applied here, of which one is the Wiener filter approach.

According to the Wiener approach, the filter $\underline{h}$ valid for one frame of data is chosen such that it minimizes the sum of the squared error between the side signal s'(n) and the filter output ŝ'(n), i.e. the sum of $$r^2(n)=[s'(n)-\hat{s}'(n)]^2,$$

where n indexing the samples of one received frame. This minimization criterion leads to requiring the error and the delayed version of signal m' being orthogonal:

$$E[m'(n-k)\cdot r(n)]=0,\ k\in[0,\ldots,P].$$

This leads to the following linear equation system for the filter coefficient vector $\underline{h}$:

$$\underline{\underline{R}}_{mm}\underline{h}_s=\Phi\cdot\underline{r}_{ms},$$

where $\underline{\underline{R}}_{mm}$ is a Toeplitz matrix of autocorrelations of signal m':

$$\underline{\underline{R}}_{mm}=[r_{mm}(j-k)],\ j,k\in[0,\ldots,P],$$

and where $\underline{r}_{ms}$ is a vector of cross-correlations of signals m' and s':

$$\underline{r}_{ms}=[r_{ms}(k)],\ k\in[0,\ldots,P].$$

After calculation, the filter coefficients are merely stored but not further used. However, if the subsequent frame is erroneous such that at least parts of the side signal s' are unavailable, then the stored coefficients will be used.

In a first step, the mono signal m'(n) will be derived. The case where also the mono signal is affected by the frame loss is discussed more in details further below. In a second step, the parametric model will be applied in order to reconstruct a substitution signal s'*(n) for the side signal. This is done by first setting the filter coefficients to those stored in the memory. Then the mono signal is filtered, which will generate the signal s'*(n).

Figure 5A:
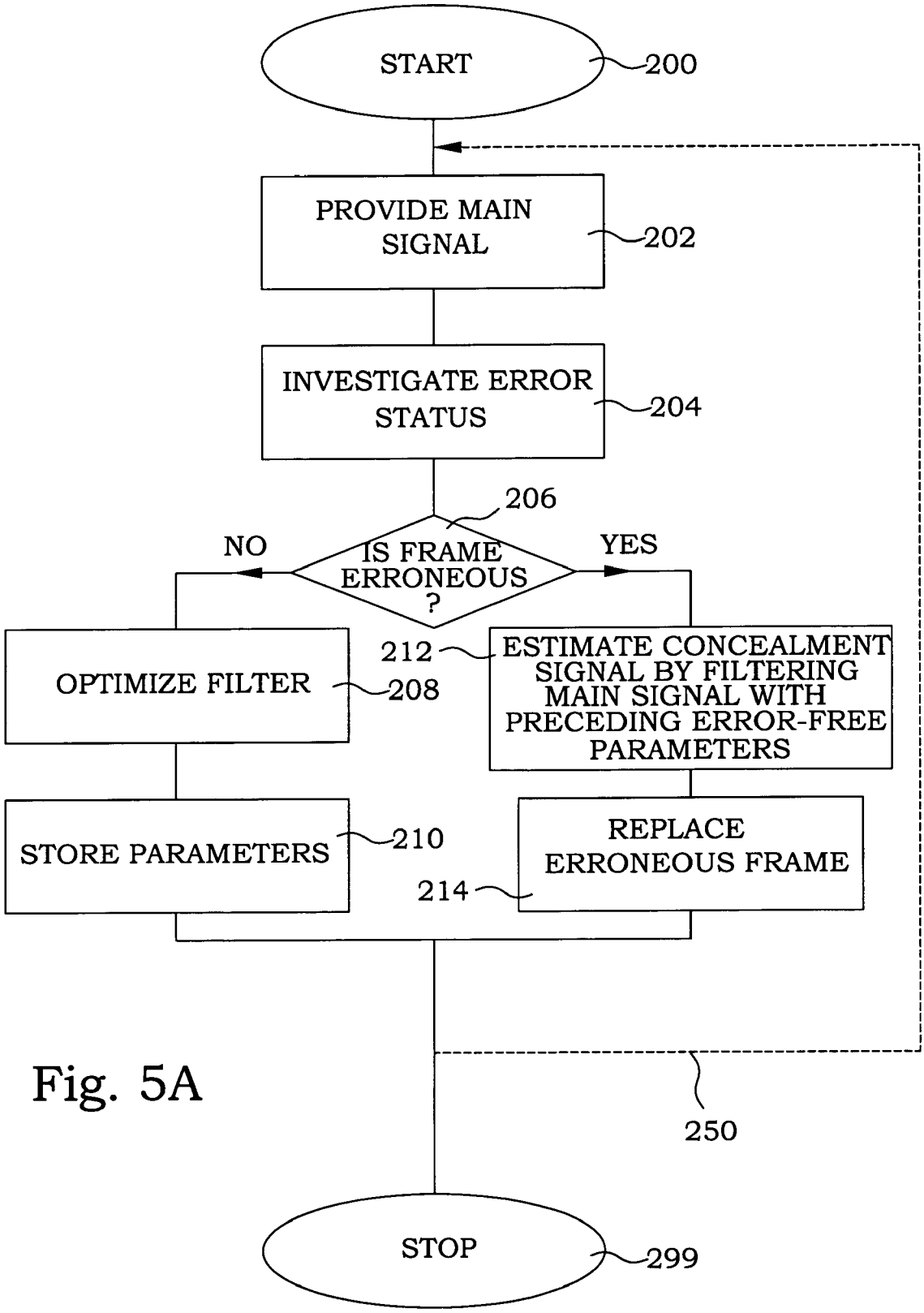
FIGS. 5A-B are flow diagrams of the main steps of example embodiments of a method.

The main acts of an example embodiment of a concealment method for a channel signal are presented in a flow diagram in FIG. 5A. The procedure starts in act 200. In act 202, an input signal is provided, preferably a main signal based on a linear combination calculation of received channel signals. The main signal can also be provided as one of the channel signals. This is a special case of the first alternative, where the "linear combination" of only one channel signal is used. The main signal can also be provided from elsewhere, e.g. as a result of another concealment procedure. Preferably, the mono signal is in some sense associated with the present channel signals. These alternatives will be further discussed below.

In act 204 the error status of the channel signal in question is investigated. In many digital systems, a frame comprising signal data is typically provided with some error status bits. The investigation act will in such a case comprise the checking of the error status bits. In other cases, where there are no explicit error status information, one has to take more detection-like actions. For instance, parity or redundancy bits can be checked. In even more advanced systems, the actual signal content could be analyzed for detecting "unrealistic" behaviors. This may e.g. be useful in analogous audio systems.

Based on the error status of the channel signal, it is decided in act 206 if the present portion or frame of the channel signal is erroneous, totally or in part. If the channel signal is error-free, the procedure continues to act 208, where the parametric filter is optimized, e.g. according to principles similar to what was described above. The optimized parameters are then stored in act 210 for any possible future use.

Based on the error status of the channel signal, it is decided in act 206 if the present portion or frame of the channel signal is erroneous, totally or in part. If the channel signal is error-free, the procedure continues to act 208 where the parametric filter is optimized, e.g. according to principles similar to what was described above. The optimized parameters are then stored in act 210 for any possible future use.

If the channel signal is erroneous in any sense, i.e. if the content is corrupt or if the frame is missing, an actual concealment procedure will take place. A signal that is going to replace and thereby conceal the erroneous signal is generated in act 212 by filtering the provided main signal in a filter defined by parameters from the preceding error-free frame or signal portion. In act 214 the generated signal replaces the erroneous signal portion, thereby concealing the error in a best possible manner. The procedure stops in act 299.

The above procedure is repeated for every signal portion, which is indicated by the broken line 250.

The above flow diagram is also valid for one of the embodiments when treating several subsequent erroneous frames. For each erroneous frame, in act 212, the filter parameters associated with the last error-free signal portion is used, regardless of how far back that signal was received. In a slightly altered embodiment, act 212 can also be modified to comprise a gradual muting of the filter parameters, which will lead to a gradual transfer to a pure main signal.

Figure 5B:
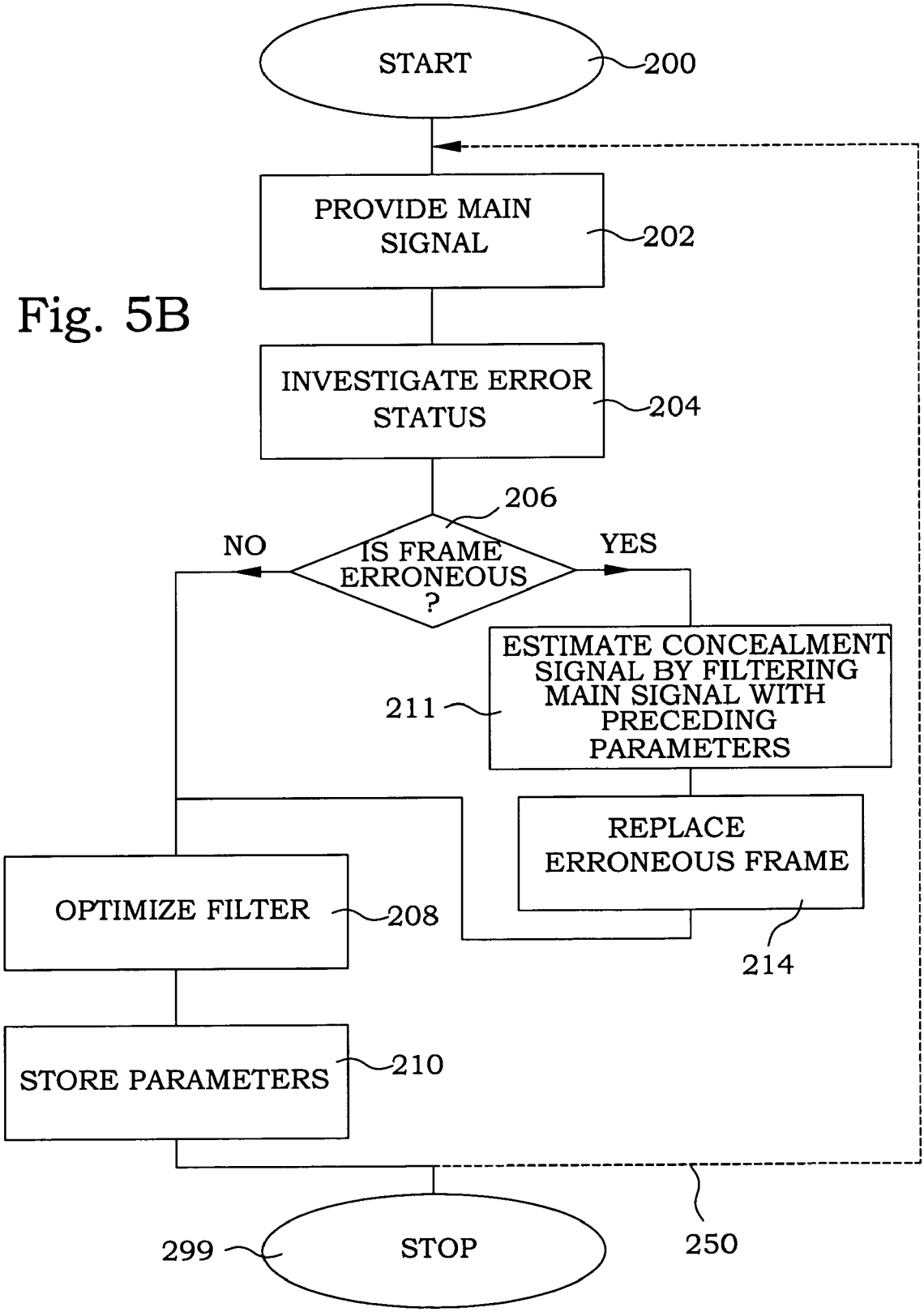

FIG. 5B illustrates an alternative embodiment. All acts that are similar as in FIG. 5A have the same reference numbers and will not be further discussed. If an erroneous signal portion is detected, the procedure will continue to act 211, in which a concealment signal is produced. This signal is based on earlier filter parameters according to any predetermined configuration.

When the concealment signal is generated and has replaced the original erroneous signal, the acts of optimizing the filter and storing the optimized parameters are performed, but now based on the concealment signal instead of an error-free original signal. In such a way, filters that in some sense comprise latest possible information can be used in successive erroneous signal portions.

In some embodiments, the act 211 may even include a combination of parameters deduced from error-free signals and from concealment signals. Such alternatives will be discussed further below.

In order further to visualize the utilization of information, FIG. 7A illustrates a concealment situation having a single erroneous signal. During a frame n−1, filter parameters $h_k(n-1)$ for channel $x_k$ are generated, based on signal information from the other channel signals. During frame n, the channel $x_k$ is erroneous and cannot be used. However, the remaining channels in frame n can be utilized to produce a main signal $m_{-k}(n)$. The main signal $m_{-k}(n)$ and the stored filter parameters $h_k(n-1)$ are then used to generate a conjecture $x_k^*(n)$ of an original signal, which is used for concealing the erroneous signal. In such a way, correlations, not only in the temporal direction, but also in the channel space, are used for creating the conjecture signal $x_k^*(n)$.

Figure 7B:
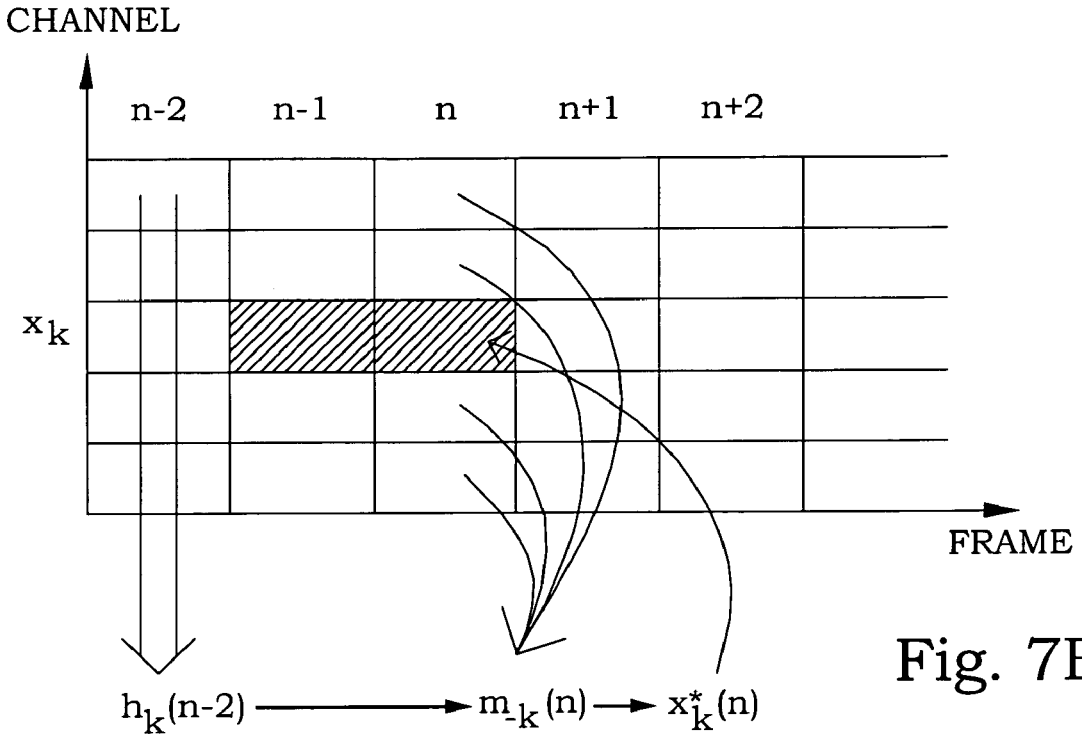

For consecutive erroneous signals, the situation may look like FIG. 7B, if the embodiment of FIG. 5A is applied. The filter parameters of frame n−2 are stored. A main signal $m_{-k}(n)$ is provided and applied to the filter with the parameters from frame n−2 to achieve a replacement signal $x_k^*(n)$. In this case, channel correlations of frame n−2 and frame n are used, together with temporal correlations between frames n−2 and n. However, the information of frame n−1 is essentially unused. For shorter sequences of erroneous frames, such an information neglecting might not be very serious. However, if the number of sequential erroneous signals becomes large, more accurate conjectures may be possible if also the intermediate frames are considered.

Figure 7C:
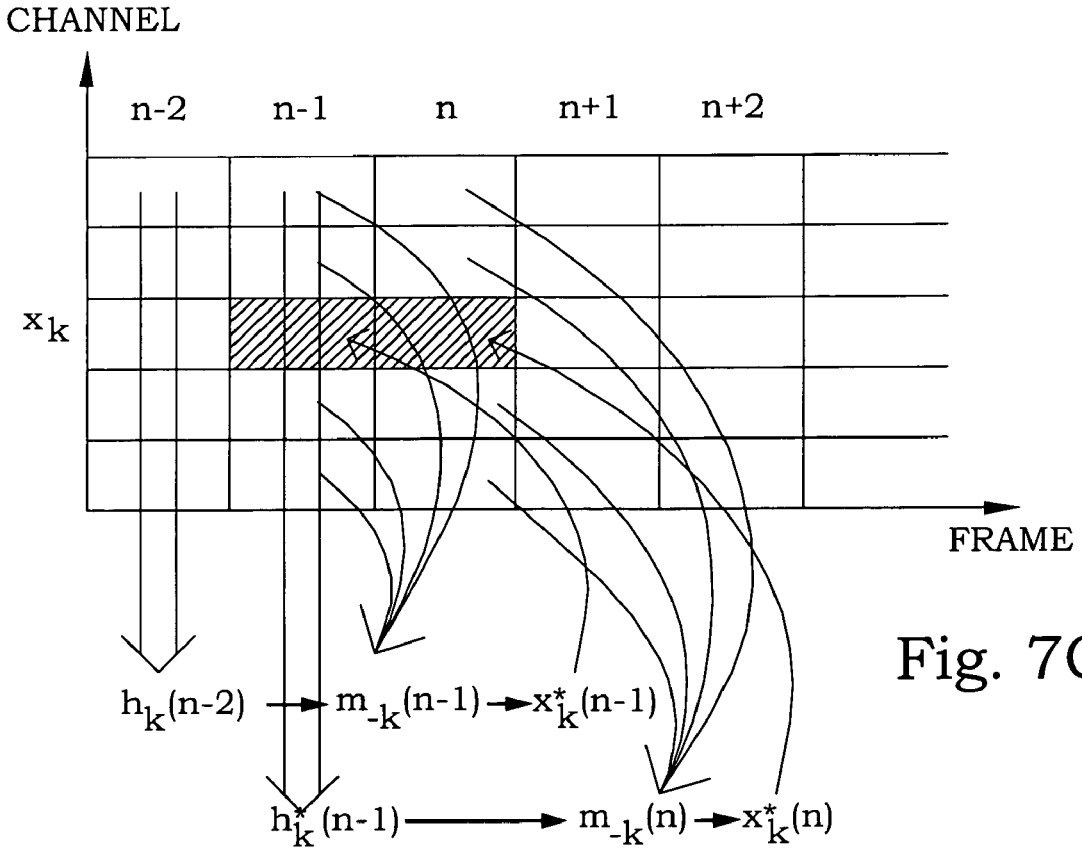

FIG. 7C illustrates the situation according to a method according to the embodiment illustrated in FIG. 5B. The error-free filter parameters $h_k(n-2)$ are achieved in the same way. However, the conjecture signal $x_k^*(n-1)$ of frame n−1 is here also utilized to produce another set of filter parameters $h_k^*(n-1)$, however, not based on totally error-free signals. A conjecture signal $x_k^*(n)$ of frame n can be determined by using the $h_k^*(n-1)$ parameters on a main signal $m_{-k}(n)$. The conjecture signal $x_k^*(n)$ will then involve correlations from both frame n and n−1.

Another possibility is to combine information deduced from the parameters $h_k^*(n-1)$ and $h_k(n-2)$, which will further increase the base upon which the concealment is founded.

Figure 7D:
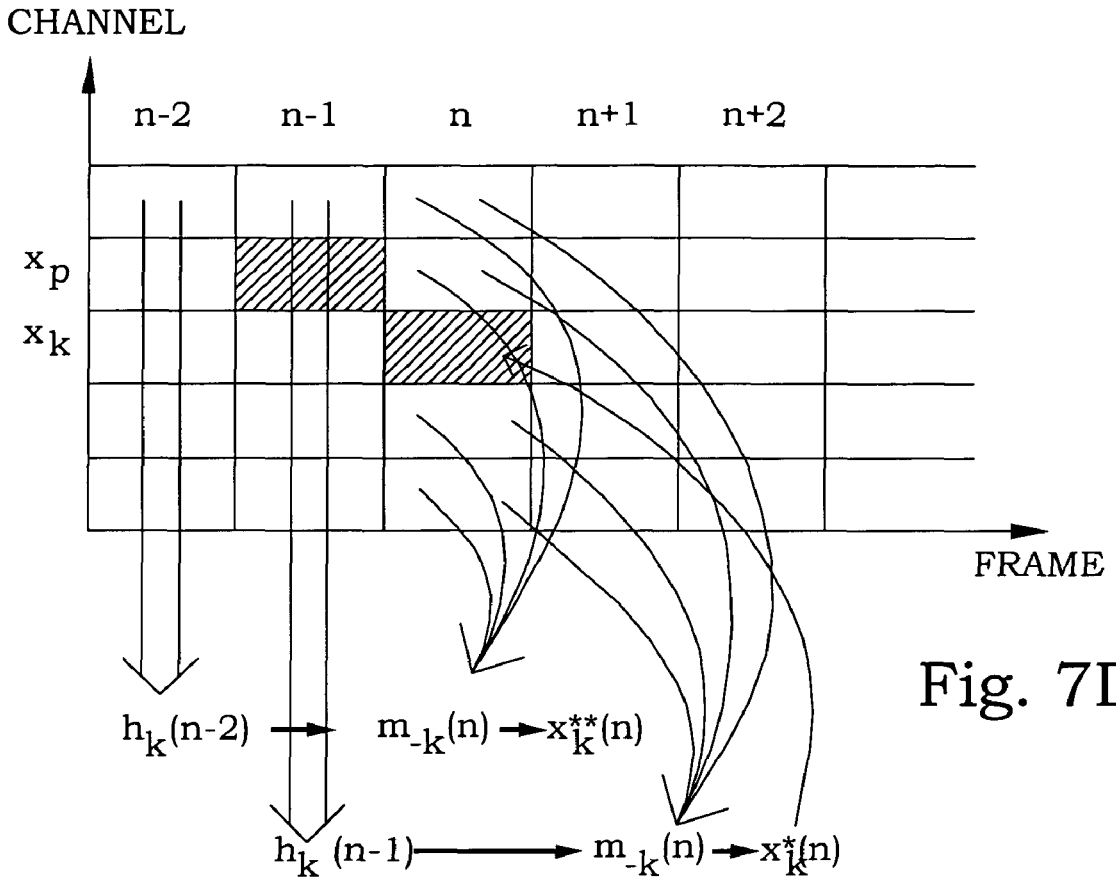

FIG. 7D illustrates a further example embodiment. The situation is that for frame n components of channel signal k are erroneous and need to be concealed. In the preceding frame n−1 at least channel p is affected by errors, but not channel k. The frame n−2 is assumed to be totally error-free. A set of filter coefficients $h_k(n-1)$ can be derived for the time instance n−1 according to the methods described above, for which a main signal $m_{-p}$ excluding the erroneous channel p is used in the derivation of the filter parameters. However, as for frame n channel signal k is erroneous, it may even be more advantageous to use a main signal $m_{-p,-k}$ excluding both channels p and k when deriving the filter parameters. Using a set of filter parameters derived such way will lead to a conjecture signal $x_k^*(n)$. As however this set is not based on totally error-free signals, it can be advantageous to use a conjecture signal $x_k^{**}(n)$ for frame n by using the filter parameters $h_k(n-2)$ derived from the last totally error-free frame n−2. An even better solution is to combine both conjecture signals or to derive the conjecture signal by applying the model using a set of filter parameters combining both sets of filter coefficients $h_k(n-2)$ and $h_k(n-1)$.

For a given channel k it is thus possible to calculate different model parameter sets, depending on which combination of channel signals is excluded from the main signal. A receiver may pre-calculate and store for each channel k all possible model parameter sets by permuting all possible combinations of channel exclusions from the main signal. Having pre-calculated all such models allows the receiver at some subsequent frame with errors to use that specific model parameter set which matches the pattern of erroneous and error-free channels.

As seen from above, it is possible to use a different linear combination of channel signals for deriving the filter parameters—a deriving input signal—than is used for generating the replacement signal—the generating input signal. However, the deriving and generating input signals are preferably as similar as possible.

Assuming an example where a multi-channel signal $x_k(n)$ is lost and needs to be recovered. This is done using the stored model coefficients derived for the last valid frame. If, however, there are several subsequent frame losses and the present lost frame is the $q^{th}$ lost frame in a row, then the stored model coefficients belong to a frame with time index n−q and the coefficient set can be denoted $h_k(n-q)$. In this case it can be beneficial to make use of parameters $h_k(n-1)$ derived from the preceding frame even though it was a recovered invalid frame. In general, the coefficients to be used for recovery of the multi-channel signal $x_k(n)$ can be derived as a combination of all parameter sets derived during the preceding frames back to the last valid frame (or even longer). One suitable choice is to use a linear combination of the parameter sets:

$$h_k(n) = \sum_{i=1}^{q} \alpha(i) \cdot h_k(n-i),$$

where $\alpha(i)$ are weighting factors which sum is equal to one.

Setting $\alpha(n-q)$ to 1 and all other weights to 0 results in only using the parameters of the last valid frame, while setting $\alpha(n-1)$ to 1 and all other weights to 0 results in only using the parameters of the previous invalid frame.

In cases of long sequences of lost frames, it can be beneficial to apply some gradual muting of the model parameters, which essentially results in a gradual attenuation of the recovered multi-channel information. In case of complete muting, no multi-channel signal will be recovered, which results in falling back to a sole playback of the mono audio channel.

One example realization of such a muting technique for the case that the model is a FIR filter is to gradually attenuate the filter coefficients. Full muting is achieved by setting all coefficients to zero.

In some applications e.g. using the real mono signal as a main signal, the main signal is not available as such, but has to be synthesized from the individual channel signals. If all the individual channel signals are defect, no useful main signal for the multi-channel concealment according to an example embodiment is available. Also, if the main signal is achieved from elsewhere, the main signal may be erroneous. In such cases, any prior-art conventional concealment technique can be employed for obtaining a substitution signal for the main signal, before the main signal is used in the creation of filter parameters or channel signal concealment signals. In case the main signal has to be obtained as a linear combination of the individual channel signals, the procedure of step 202 in FIGS. 5A and 5B may look like FIG. 6. Entering from step 200, a decision whether all the individual channel signals are erroneous and thereby no useful main signal is available has to be made in step 216. As in the investigation of the error status of a particular channel signal, this decision can be based on either frame error status bits or on more sophisticated error detection techniques. If any of the channel signals is error-free, the procedure continues to step 220, in which a linear combination of the non-defective channel signals is created as the main signal excluding the erroneous channel signals. If all channel signals are erroneous, the procedure continues to step 218, where a main signal concealment technique according to conventional methods is used for providing an estimated main signal, which later can be used in the channel signal concealment procedure according to an example embodiment. A case in which multiple channel signals are erroneous and the technology is applied recursively in order to recover all erroneous channel signals will be described below.

Even if the present technology is applicable in systems using any kind of encoding schemes, there might be some additional advantages when applying it to systems using encodings based on parametric filters. When considering e.g. FIG. 1C, it can be seen that if the decoder uses parametric decoding based on a mono signal, the very same mono signal may be provided also to the concealment device. An error in one channel signal may therefore not necessarily affect the mono signal.

Figure 8:
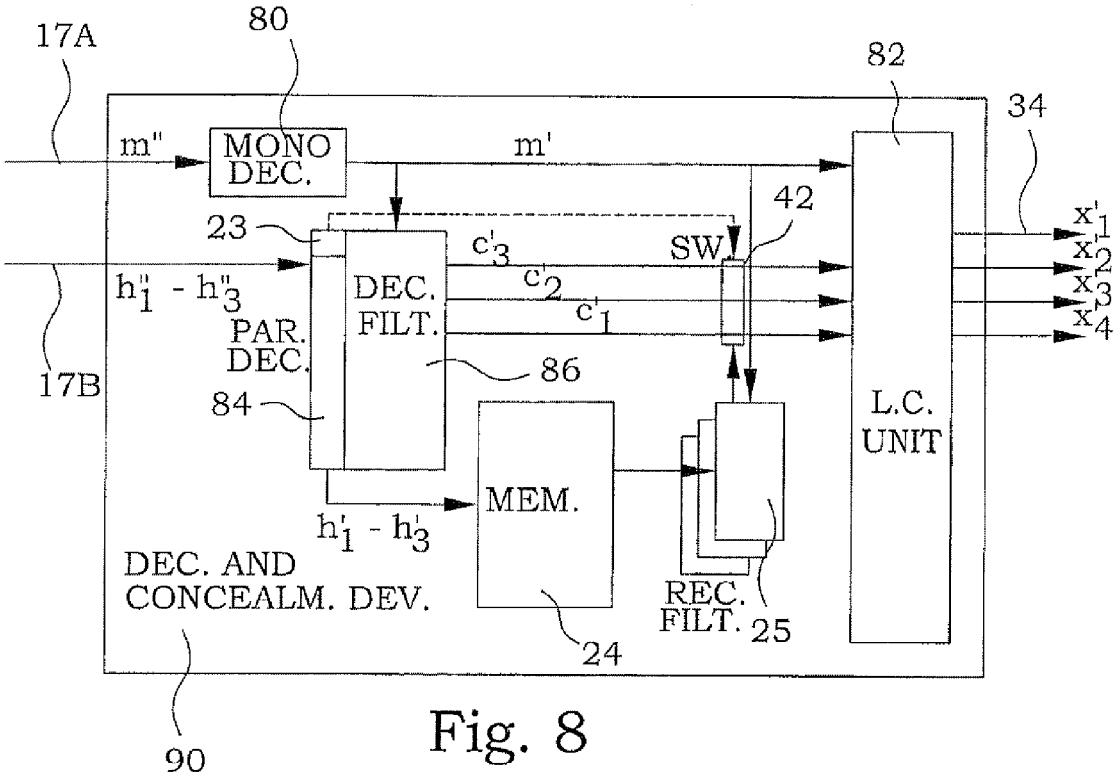
FIG. 8 is a block diagram illustrating an implementation of an example embodiment of a concealment device integrated in a parametric filter decoder.

Furthermore, if the decoder utilize the same filter type as in the concealment device, further advantages can be made. FIG. 8 illustrates a combined decoder and concealment device 90, both based on parametric filter techniques. An encoded mono signal m" is provided at a first connection 17A, and encoded filter parameters $h''_1$-$h''_3$ are provided at a second connection 17B. The mono signal is decoded in a mono signal decoder 80 according to any conventional mono signal techniques, giving a decoded mono signal m'. The mono signal m' is provided to a decoder filter unit 86.

The encoded filter parameters $h''_1$-$h''_3$ are decoded in a parameter decoder 84. The decoded filter parameters $h'_1$-$h'_3$ are provided to a decoder filter unit 86 for defining a filter, which applied to the mono signal regenerates linear combinations $c'_1$-$c'_3$ of channel signals. The linear combinations $c'_1$-$c'_3$ and the mono signal m' are combined in a linear combination unit 82 to four channel signals $x'_1$-$x'_4$.

The decoded filter parameters $h'_1$-$h'_3$ are also provided to a memory 24 for storage waiting for any possible future use. An error status investigating means 23 checks if the parameters are erroneous or not. If an error is discovered, the decoded mono signal is additionally provided to a reconstruction filter 25, defined by stored filter parameters. The generated signal replaces the erroneous signal by a switch means 42 in analogy with earlier described embodiments.

Figure 9:
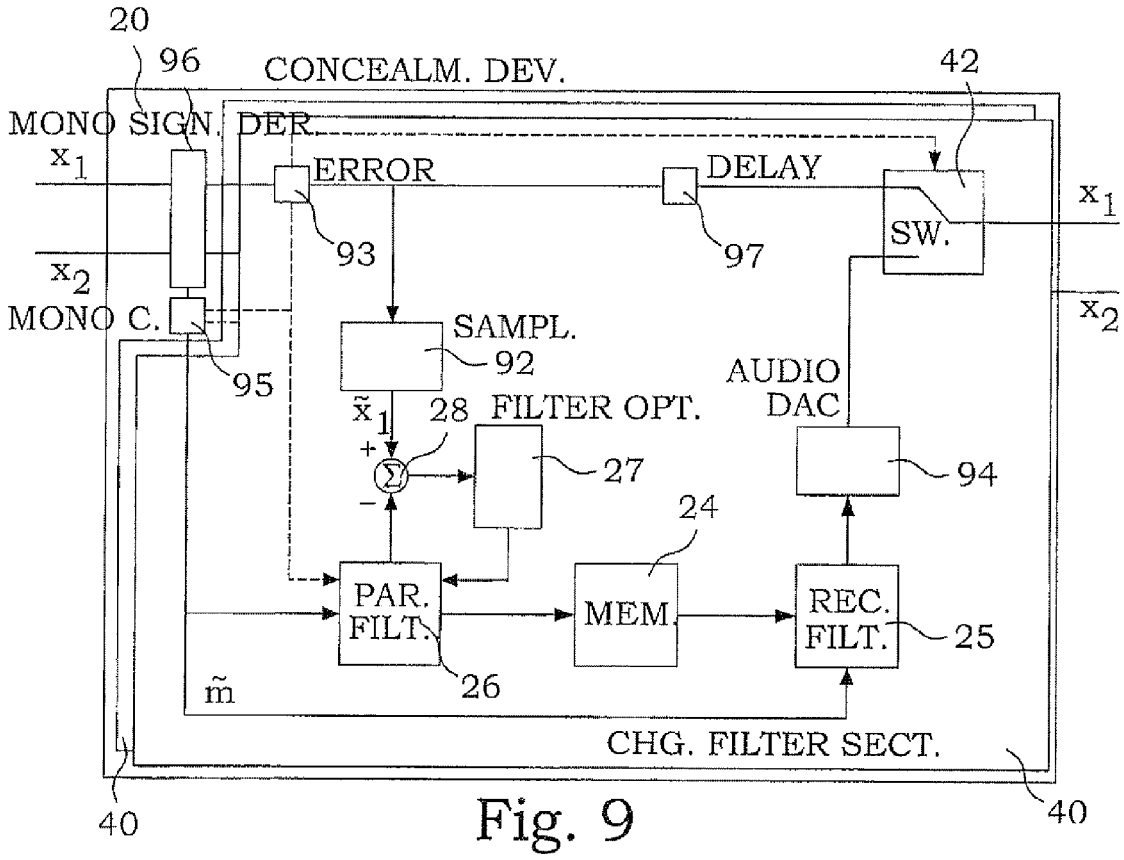
FIG. 9 is a block diagram of an example embodiment of an analogue audio system.

Even if the present technology is based on digital processing of audio signals, the technology can also be applied on analogous audio systems. FIG. 9 illustrates a block scheme of an example embodiment of a concealment device 20 applied in an analogous audio system. Two analogue channels $x_1$ and $x_2$ are provided to a mono signal deriving unit 96 in the concealment device 20. The mono signal deriving unit 96 takes the average of the two channels and samples the combined signal into a digital representation of the mono signal $\tilde{m}$. The analogue signals are forwarded to one channel filter section 40 each, of which only one is illustrated in detail.

An error detector 93 is connected to sense the characteristics of the analogous signal. Normal audio signals typically follow certain statistical behaviors, where the changes in signal characteristics either is fairly slow or follows certain harmonics statistics. An error in an analogous signal often appears as a sudden and extremely uncorrelated change in the spectral characteristics. There are different kinds of detectors in prior art for finding probable error portions of analogous audio signals. If no error is detected in the error detector 93, the analogous signal is brought through a delay unit 97 for adjusting the timing of an unmodified analogous signal to the timing of a concealed error signal. A switch means 42 provides the unaltered analogous signal on the output from the channel filter section 40.

If no error is detected, the analogous signal is also transferred to sampling unit 92, where the analogous audio signal is digitized and divided in frames of a predetermined duration. The digitized version of the channel signal $\tilde{x}_1$ is in analogy with the description above used for optimizing a parametric filter 26. The digitized mono signal $\tilde{m}$ is used as input signal of the filter 26, and a filter optimizing means 27 optimizes the parameters, which then are stored in a memory 24. During non-error conditions, these are the complete actions.

However, if the error detector 93 finds an error in the analogous signal, the switch means 42 is controlled to instead accept an analogous concealment portion. The digitized mono signal $\tilde{m}$ is modified by any prior art methods for mono signal concealment in a mono signal concealment unit 95 if any of the channel signals are erroneous. The modified mono signal is provided to a reconstruction filter 25 defined by parameters earlier stored in the memory 24, in analogy with the above described principles. The digital concealment signal is brought to a digital-to-analogue audio converter 94, which converts the digital signal into an analogue signal, which is connected by the switch means 42 to replace the erroneous signal.

The present technology is thereby possible to use also for analogous audio signal restoration.

One aspect of the present technology is the possibility to apply the technique to components of the different audio channels rather than only to the complete audio channels. It is e.g. possible to apply the technology on one or several sub-bands or spectral components. One specific example embodiment is the application in a predetermined frequency range, preferably comprising only frequencies below 2 kHz and more preferably only to spectral components below 1 kHz.

The resulting output signal of a concealment device according to an example embodiment can be combined with concealment signals obtained by other concealment methods. This can for example be done by means of averaging or weighting the generated replacement signals in different relations.

The present concealment method can also be used in a recursive manner in order to conceal erroneous signals of more than one channel. The method is initially applied such that it recovers a first erroneous channel signal based on the available main signal excluding the erroneous channel signal portions. Then, subsequently, all other erroneous channel signals are recovered recursively, where each of these recursions make use of the available main signal excluding the erroneous channel signal portions and the recovered multi-channel signals of the previous recursion.

If the main signal is affected by the erroneous signal, the present concealment method can also be used in a recursive manner also for a single channel. A first replacement signal is generated based on a recovered main signal. This first replacement signal is then utilized to refine the estimation of the true main signal and the method can be repeated to generate a refined replacement signal. Such a procedure can be repeated until the change between two successive replacement signals falls below a certain limit. Also when more than one channel signal is erroneous, the procedure can be repeated cyclically to successively refine the replacement signals.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined into other configurations, where technically possible. The scope of the present invention is, however, defined by the appended claims.

REFERENCES

U.S. Pat. No. 6,490,551
DE 3638922
3 GPP TS 26.091, clauses 6 and 7.
EP 0 637 013

The invention claimed is:

1. The method for recovering erroneous components of multi-channel signals, comprising:

deriving in a decoder and storing, during error-free conditions for a predetermined channel signal which is a multichannel signal, parameters $h_k$ of a parametric model giving an estimate of a portion of the predetermined channel signal when applied to a deriving input signal, wherein the input signal is a linear combination of at least one other of the multi-channel signals than the predetermined channel signal;

detecting in the decoder if at least a portion of the predetermined channel signal is erroneous;

generating in the decoder, when a portion of the predetermined channel signal is erroneous, a replacement signal portion to the erroneous portion of the predetermined channel signal by applying the parametric model based on the stored parameters associated with a preceding error-free signal to a generating input signal; and wherein the parametric model comprises a filter configured to filter the input signal and wherein coefficients of the filter comprise the parameters that are defined during the error-free conditions.

2. The method according to claim 1, wherein the deriving, detecting and generating are performed for each of the channel signals.

3. The method according to claim 2, wherein the input signals for at least two of the channel signals are different.

4. The method according to claim 1, wherein the erroneous portion of the at least one channel signal is missing or not completely correct.

5. The method according to claim 1, wherein the input signals are corresponding portions of a linear combination of the channel signals.

6. The method according to claim 5, wherein the deriving input signal is equal to the generating input signal.

7. The method according to claim 5, wherein the linear combination of the deriving input signal is equal to the linear combination of the generating input signal.

8. The method according to claim 5, wherein a plurality of sets of parameters $h_k$ of the parametric model are derived for a plurality of linear combinations in the deriving and storing, whereby the generating the replacement signal comprises selecting the set of parameters $h_k$ associated with the same linear combination as an available generating input signal.

9. The method according to claim 6, wherein the linear combination is proportional to a sum of the channel signals.

10. The method according to claim 5, further comprising:

estimating erroneous portions of the linear combination of channel signals by temporal error concealment, whereby at least parts of the estimated portions of the linear combination are used in the linear combination.

11. The method according to claim 5, wherein the linear combination excludes at least a portion of the predetermined channel signal.

12. The method according to claim 1, wherein the input signal is a noise signal.

13. The method according to claim 1, further comprising:

generating replacement signal portions to subsequent erroneous portions of the predetermined channel signal by applying the associated parametric model based on at least the stored parameters associated with the last error-free signal to the input signal.

14. The method according to claim 1, further comprising:

deriving and storing model parameters of the parametric model associated with replacement signal portions of the predetermined channel signal; and generating replacement signal portions to subsequent erroneous portions of the predetermined channel signal by applying the associated parametric model based on at least the stored parameters associated with a preceding replacement signal portion to the input signal.

15. The method according to claim 1, further comprising:

gradually muting model parameters during subsequent erroneous portions of the predetermined channel signal.

16. The method according to claim 1, wherein the portions of signals are frames of digital signals.

17. The method according to claim 16, wherein the detecting comprises monitoring of frame status information.

18. The method according to claim 1, wherein the portions of signals are portions of analogue signals having uniform durations.

19. The method according to claim 18, wherein the detecting comprises analyzing the spectral characteristics of the analogue signals.

20. The method according to claim 18, further comprising:

converting analogue channel signals to digital channel signals;

whereby the deriving and storing model parameters is based on the digital channel signals;

converting recovered digital signal portions to analogue signal portions; and replacing erroneous analogue signal portions with the recovered analogue signal portions.

21. The method according to claim 1, wherein the signal portions are limited in a frequency range.

22. The method according to claim 21, wherein the method is applied on sub-bands of the multi-channel signals.

23. The method according to claim 1, further comprising:

generating a second replacement signal portion for the erroneous portion according to a second temporal signal recovery method; and combining the first and the second replacement signal portions into a final replacement signal portion, which is used to replace the erroneous channel signal portion.

24. The method according to claim 1, comprising the method is applied recursively on more than one simultaneously erroneous channel signal.

25. A multi-channel signal error concealment device, comprising:

means for deriving in a decoder and storing model parameters of a parametric model giving an estimate of portions of a predetermined channel signal which is a multichannel signal when applied to a deriving input signal, wherein the input signal is a linear combination of at least one other of the multi-channel signals than the predetermined channel signal;

error status investigating means for detecting in the decoder erroneous portions of channel signals;

means for generating in the decoder a replacement signal portion of an erroneous portion of the predetermined channel signal, connected to the means for deriving and storing model parameters, by applying the associated parametric model based on the stored parameters associated with a preceding error-free signal to a generating input signal; and wherein the parametric model comprises a filter configured to filter the input signal and wherein coefficients of the filter comprise the parameters that are defined during the error-free conditions.

26. An audio system comprising a multi-channel signal error concealment device according to claim 25.

27. The audio system according to claim 26, wherein the multi-channel signal error concealment device is connected to or integrated in a receiver.

28. The audio system according to claim 26, wherein the multi-channel signal error concealment device is connected to an analogue audio signal system.

* * * * *

UNITED STATES PATENT AND TRADEMARK OFFICE

CERTIFICATE OF CORRECTION

PATENT NO. : 7,835,916 B2
APPLICATION NO. : 11/012717
DATED : November 16, 2010
INVENTOR(S) : Bruhn It is certified that error appears in the above-identified patent and that said Letters Patent is hereby corrected as shown below:

On The Title Page

On Page 2, in Item (56), under "FOREIGN PATENT DOCUMENTS", in Column 2, Line 5, delete "WO WO 03/107591 12/2003".

In The Specification

In Column 2, Lines 16-19, delete "Another similar technique particularly for stereo signals is described in the patent DE 3638922 according to which lost signal sections of one of the stereo channels are replaced by corresponding signal sections of the other channel.".

In Column 8, Lines 61-67, delete "Based on the error status of the channel signal, it is decided in act 206 if the present portion or frame of the channel signal is erroneous, totally or in part. If the channel signal is error-free, the procedure continues to act 208 where the parametric filter is optimized, e.g. according to principles similar to what was described above. The optimized parameters are then stored in act 210 for any possible future use.".

In Column 9, Line 7, delete "214" and insert -- 214, --, therefor.

In Column 10, Line 25, delete "$x_k^{**}(n)$" and insert -- $x_k^{*}(n)$ --, therefor.

Signed and Sealed this
Twenty-first Day of June, 2016

Michelle K. Lee

Michelle K. Lee
*Director of the United States Patent and Trademark Office*